US012588767B2

(12) United States Patent
Kassoul

(10) Patent No.: US 12,588,767 B2
(45) Date of Patent: Mar. 31, 2026

(54) FUNCTIONAL MATTRESS

(71) Applicant: Aboubakr Kassoul, Lorient (FR)

(72) Inventor: Aboubakr Kassoul, Lorient (FR)

( * ) Notice: Subject to any disclaimer, the term of this patent is extended or adjusted under 35 U.S.C. 154(b) by 537 days.

(21) Appl. No.: 17/999,476

(22) PCT Filed: Mar. 22, 2021

(86) PCT No.: PCT/FR2021/050470
§ 371 (c)(1),
(2) Date: Nov. 21, 2022

(87) PCT Pub. No.: WO2021/234233
PCT Pub. Date: Nov. 25, 2021

(65) Prior Publication Data

US 2023/0200548 A1 Jun. 29, 2023

(30) Foreign Application Priority Data

May 21, 2020 (FR) ..... 2005417

(51) Int. Cl.
*A47C 20/00* (2006.01)
*A47C 27/08* (2006.01)

(52) U.S. Cl.
CPC ..... *A47C 20/00* (2013.01); *A47C 27/082* (2013.01)

(58) Field of Classification Search
CPC ..... A47C 20/00; A47C 20/023; A47C 27/082; A47C 27/146; A47C 31/123; A61G 7/05723
USPC ..... 5/710, 722, 733, 930
See application file for complete search history.

(56) References Cited

U.S. PATENT DOCUMENTS 2,462,579 A * 2/1949 Warner ..... A47C 27/146 5/733
2,550,293 A * 4/1951 Platis ..... A47C 27/001 5/733
2,807,033 A * 9/1957 Austen ..... A47C 27/144 5/725
2,810,920 A * 10/1957 Carruth ..... A47C 20/026 5/725
2,990,558 A * 7/1961 Engel ..... A47C 27/144 5/725
3,808,615 A * 5/1974 Geary ..... A61G 7/1032 5/725
3,988,793 A * 11/1976 Abitbol ..... A47C 20/025 5/930

(Continued)

FOREIGN PATENT DOCUMENTS

CN 2724533 Y 9/2005
CN 210020048 2/2020

(Continued)

OTHER PUBLICATIONS

International Search Report for International Application No. PCT/FR2021/050470 dated Jun. 11, 2021, 2 pages.

(Continued)

*Primary Examiner* — David R Hare
(74) *Attorney, Agent, or Firm* — TraskBritt

(57) ABSTRACT

An assembly includes a mattress and an associated device, wherein the mattress has an open groove on a sleeping face, and the associated device is designed to at least partially block the groove when it is placed in the groove.

17 Claims, 5 Drawing Sheets

(56) References Cited

U.S. PATENT DOCUMENTS 5,185,897 A * 2/1993 Van Laanen ..... A47C 20/025 5/710
5,369,824 A * 12/1994 Powell ..... A47C 27/146 5/735
5,425,147 A * 6/1995 Supplee ..... A47C 20/026 5/713
D392,145 S * 3/1998 Thurston ..... 5/735
6,105,187 A * 8/2000 Gnjatovic ..... A61G 7/07 5/616
6,516,481 B1 * 2/2003 Erickson ..... A47C 27/144 5/724
7,614,105 B1 * 11/2009 Jackson ..... A47C 7/383 5/640
8,661,591 B1 * 3/2014 Sonderland ..... A47C 27/146 5/733
10,820,718 B1 * 11/2020 Hall ..... A47C 31/105
10,842,287 B1 * 11/2020 Vigil ..... A47C 21/044
11,737,574 B2 * 8/2023 Dudley ..... A47C 23/00 5/725
2006/0096034 A1 * 5/2006 Tucci ..... A47C 27/148 5/722
2007/0101505 A1 * 5/2007 Oprandi ..... A47C 27/148 5/713
2009/0217459 A1 * 9/2009 Rudolph ..... A47C 21/042 5/725
2020/0078242 A1 * 3/2020 Smith ..... A61B 5/024

FOREIGN PATENT DOCUMENTS

EP 1352597 B1 1/2006
KR 10-1999-0012041 A 2/1999

OTHER PUBLICATIONS

International Written Opinion for International Application No. PCT/FR2021/050470 dated Jun. 11, 2021, 5 pages.
Chinese Office Action for Application No. 202180004897.3 dated Jun. 11, 2025, 13 pages with English translation.

* cited by examiner

FUNCTIONAL MATTRESS

CROSS-REFERENCE TO RELATED APPLICATIONS

This application is a national phase entry under 35 U.S.C. § 371 of International Patent Application PCT/FR2021/050470, filed Mar. 22, 2021, designating the United States of America and published as International Patent Publication WO 2021/234233 A1 on Nov. 25, 2021, which claims the benefit under Article 8 of the Patent Cooperation Treaty to French Patent Application Serial No. FR2005417, filed May 21, 2020.

TECHNICAL FIELD

The present disclosure relates to the field of mattresses.

BACKGROUND

When a couple sleeps together with one on the other's arm, it causes compression of the vessels and nerves in the arm, which causes pain that requires changing positions after a few tens of minutes.

The radial nerve contributes to the sensory innervation of the hand. It is primarily a motor nerve that allows extension and supination.

Without a change in position, the person whose arm is below the other may experience radial nerve palsy, which is often referred to as Saturday night palsy. This palsy is reversible.

An aim of the present disclosure is to provide a mattress that avoids this drawback.

BRIEF SUMMARY

To this end, there is proposed, according to a first aspect of the present disclosure, an assembly formed by a mattress and an associated device, in which:

the mattress has an open groove on a sleeping face, and the associated device is designed to at least partially block the groove when it is placed in the groove.

The groove is partial in the thickness of the mattress. The groove does not reach the face opposite the sleeping face. Of course, when the mattress has two sleeping faces, for example, a summer face and a winter face, one or more grooves can be provided on one and/or the other of the two faces.

Thus, the assembly has a configuration in which the mattress has a groove in which to pass the arm, and a configuration in which the groove is at least partially filled for conventional sleeping.

According to one embodiment, the associated device has a conformation complementary to the groove, the associated device completely blocking the groove when it is placed in the groove.

According to one possibility, the associated device has a surface flush with the sleeping face when it is placed in the groove.

According to another possibility, the associated device is provided with a part that protrudes on the sleeping face.

Advantageously, the assembly according to the first aspect of the present disclosure may comprise a system for attaching the associated device to the mattress.

In one embodiment, the associated device is inflatable.

To this end, the assembly may further comprise an inflation motor arranged to inflate the associated device.

According to one possibility, the inflation motor may be housed in the associated device.

According to another possibility, the inflation motor may be placed at a distance from the associated device, the associated device being provided with an inflation port designed to be fluidly connected to the inflation assembly.

The mattress may be equipped with an inflation duct opening into the groove and which is designed to be connected to the inflation port.

The mattress may comprise the inflation motor within it.

Alternatively, the mattress may be provided with an inflation port fluidly connected to the inflation duct.

According to a second aspect of the present disclosure, there is proposed a fitted sheet in two or more parts provided for a mattress assembly according to the first aspect of the present disclosure, or one or more of its improvements, whereof one or more parts are provided to cover the mattress(es) of the assembly, the other part(s) being provided to cover the associated device(s) of the assembly.

BRIEF DESCRIPTION OF THE DRAWINGS

Other features and advantages of the present disclosure will become apparent from the detailed description that follows, for the understanding of which reference is made to the accompanying drawings, in which.

DETAILED DESCRIPTION

Since the embodiments described hereinafter are not limiting in nature, it is possible, in particular, to consider variants of the present disclosure that comprise only a selection of the features that are described, provided that this selection of features is sufficient to confer a technical advantage or to differentiate embodiments of the present disclosure from the prior art. This selection comprises at least one preferably functional feature without structural details, or with only a portion of the structural details if this portion alone is sufficient to confer a technical advantage or to differentiate embodiments of the present disclosure from the prior art.

Figure 1:
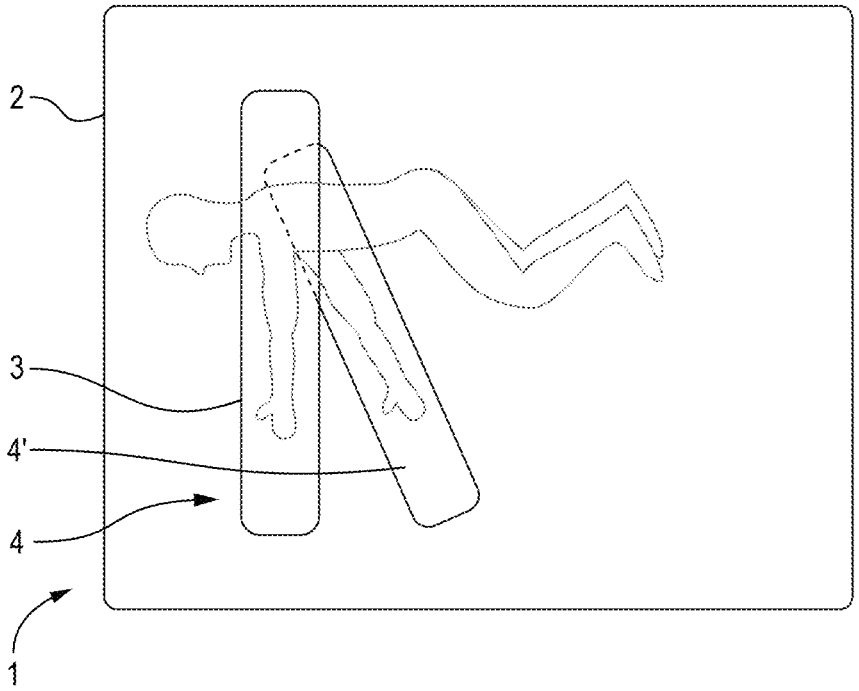
FIG. 1 is a schematic top view of an assembly according to the present disclosure.
Figure 2:
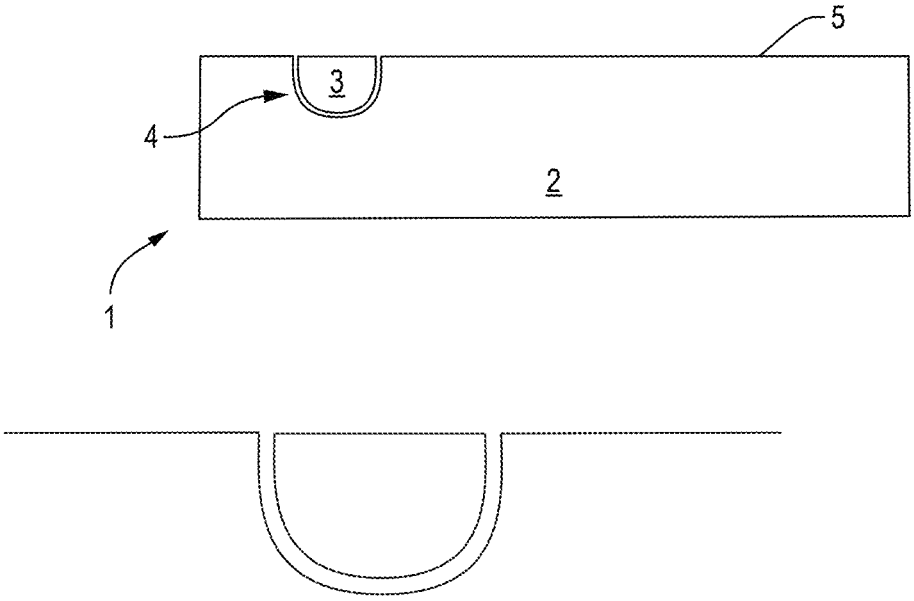
FIG. 2 illustrates, in its upper part, a schematic side view of the assembly of FIG. 1, and in its lower part illustrates a magnification of a detail of the upper part.

Referring to FIGS. 1 and 2, there is proposed an assembly 1 formed by a mattress 2 and an associated device 3.

The mattress has a length, also called the longitudinal direction, and a width, also called the transverse direction.

The longitudinal direction and the transverse direction define a plane parallel to a sleeping surface of the mattress. The mattress further has a thickness, in a direction perpendicular to the longitudinal direction and to the transverse direction.

The mattress has a groove 4 on a sleeping face 5.

As is remarkable in FIG. 1, the groove 4 is partial in the transverse direction. In other words, the groove does not lead to the side edges of the mattress. Since the groove is partial, the mattress is more comfortable if one sits on the side edges of the mattress at the height of the grooves, because there is only one compartment instead of three. The mattress according to the present disclosure allows the heights of the edges of the mattress and of the associated device to be preserved (avoiding settling or sagging) for a longer time in the event of repeated pressure on the edges.

The associated device 3 is blocked by five surfaces and is therefore only movable along a single axis, the axis perpendicular to the sleeping surface, which prevents the associated device from leaving the groove or sliding to the sides in the event frictional forces are applied in the major axis of the device when the individual turns. This also helps prevent the mattress from being quickly damaged by the forces exerted on the fasteners.

According to another embodiment, the groove could lead only to a medial edge in the case of a double bed with two juxtaposed mattresses (described below).

The associated device 3 may have a shape that is exactly complementary to that of the groove 4, as is more particularly visible in FIG. 2.

As is remarkable in FIG. 2, the groove 4 is partial depending on the thickness of the mattress.

The associated device is designed to at least partially block the groove when it is placed in the groove.

The associated device is, for example, a cushion.

The associated device could be formed from one or more complementary parts. It is thus possible to put one or more associated devices or cushions in the groove.

Figure 3:
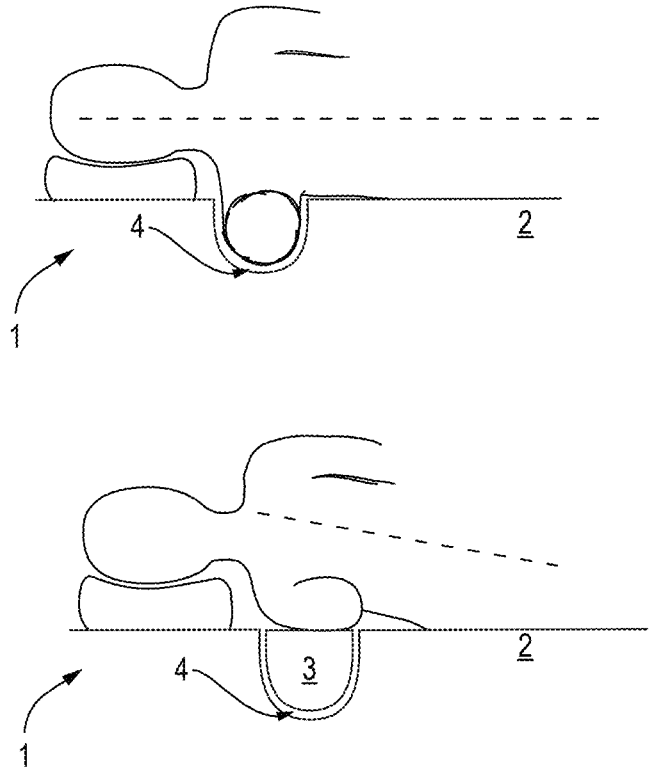
FIG. 3 illustrates, in its upper part, a first configuration of the assembly of FIG. 1, and in its lower part illustrates a second configuration of the assembly of FIG. 1.

Thus, the assembly has a configuration in which the mattress has a groove provided to pass the arm, and a configuration in which the groove is at least partially filled to allow typical sleeping, as is better visible in FIG. 3.

The groove 4 is made in the transverse direction of the bed. Other directions are possible, as illustrated by the groove 4' in FIG. 1. The grooves may be of different dimensions, of different shapes, rectilinear or not, transverse or with different angles.

The mattress 2 may have one or more grooves 4.

The associated device 3 fills the groove 4 completely or partially. It may be made of any material (one or more), hollow or solid, of any shape, of any size, inflatable or not.

Figure 4:
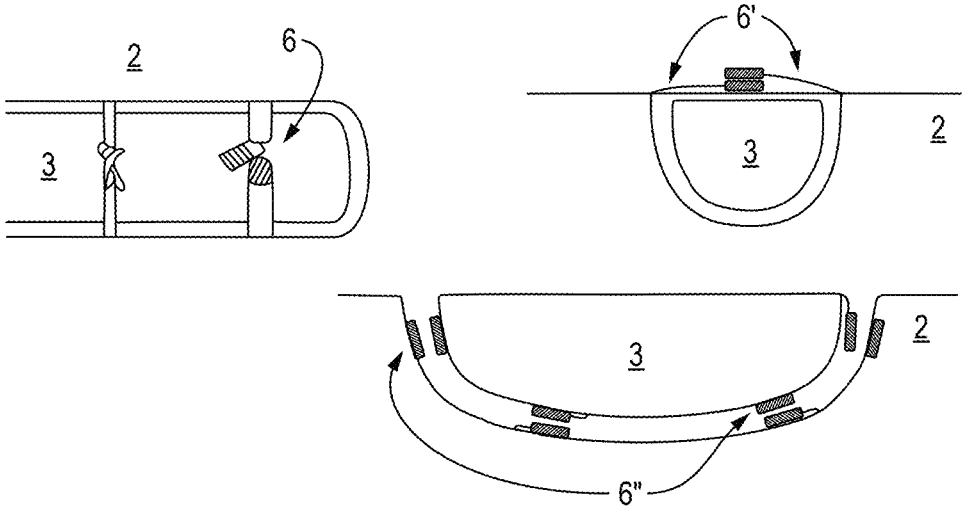
FIG. 4 illustrates different attachment systems of the assembly illustrated in FIG. 1.

Referring to FIG. 4, different attachment systems 6, 6', 6" are shown of the associated device 3 on the mattress. The attachment system 6 ensures that the associated device 3 does not fall in the event of a transfer of the mattress.

Different types of attachment systems are provided, such as a knot, hook and loop fasteners, a zipper, buttons, etc. Materials may vary.

An attachment system 6 is provided between the mattress 2 and the associated device 3 by links starting from the mattress 2 and surrounding the associated device 3, the links being tightened by knots.

An attachment system 6' is provided between the mattress 2 and the associated device 3 by two hook and loop fasteners starting from the sleeping face of the mattress 2 and preventing the removal of the associated device 3 when they are fastened on one another.

An attachment system 6" is provided between the mattress 2 and the associated device 3 by hook and loop fasteners placed on the associated device 3 and in the groove 4.

Figure 5:
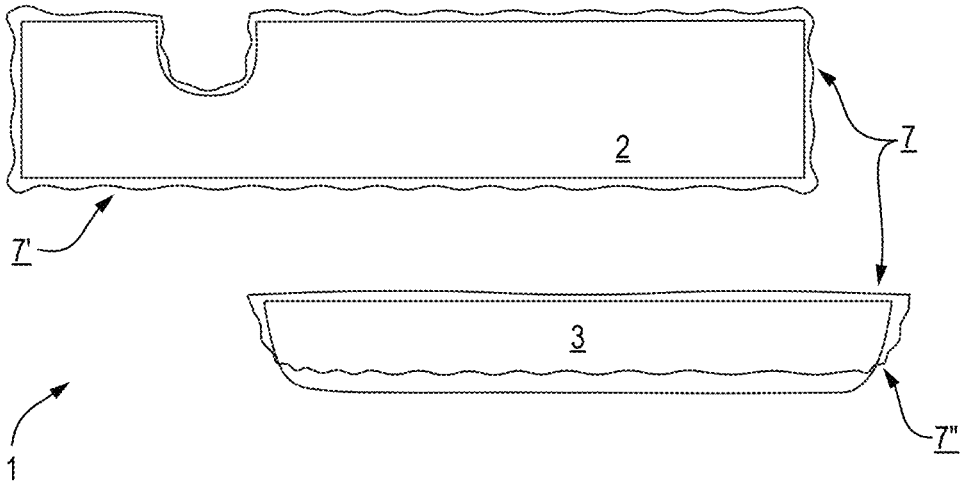
FIG. 5 illustrates a fitted sheet for the assembly shown in FIG. 1, FIG. 6, a schematic view of an assembly according to the present disclosure, FIG. 7, a schematic view of an assembly according to the present disclosure, FIG. 8, a schematic view of another assembly according to the present disclosure, FIG. 9, a schematic view of another assembly according to the present disclosure, FIG. 10, a schematic view of another assembly according to the present disclosure.

Referring to FIG. 5, a fitted sheet 7 according to the present disclosure is illustrated. The fitted sheet 7 has two or more parts 7', 7", 7'", etc. One or more of the parts 7' are provided to cover the mattress(es) 2 of the assembly.

The part 7' is provided with one or more parts that follow the shape(s) and dimensions of the groove(s) 4 on the mattress 2. This part can be made from one or more fabrics, in particular, for the groove 4.

The part 7' may have one or more large holes of the same shape as the groove(s) 4, in particular, in the case of an impermeable fitted sheet.

The part 7' may have one or more large holes in the bottom(s) of the groove(s) 4, in order to be able to communicate between the grooves 4 in the event of a tunnel allowing the passage of an arm (described below).

The part 7' may have a small extension in the bottom(s) of the groove(s) 4, to line the walls of the tunnel that allows the passage of an arm.

The part 7' may have small holes to allow the attachment system 6 to function properly, as well as holes to allow an inflation system (described below) to pass.

The other part(s) 7", 7'", etc., are provided to cover the associated device(s) 3, 3', 3'*a*, etc.

The associated device 3 can be inflatable.

Figure 6:
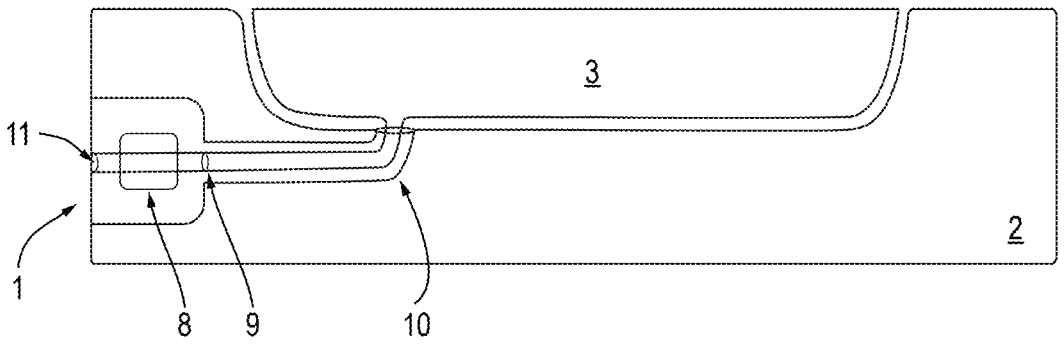

According to one embodiment described with reference to FIG. 6, the assembly 1 may comprise an inflation motor 8 arranged to inflate the associated device 3.

As shown, the inflation motor 8 is arranged at a distance from the associated device 3, the associated device being provided with an inflation port designed to be fluidly connected to the inflation motor.

More precisely, the inflation motor 8 is arranged within the mattress 2.

The assembly 1 further comprises a duct 9 opening into the groove 4 and which is intended to be connected to the inflation port. The duct 9 may be resistant to crushing. Otherwise, the duct 9 passes through a sheath 10 that is resistant to crushing.

The associated device 3 does not come completely off the mattress 2, and therefore inflates and deflates inside the groove 4.

Leak prevention systems 11 may be arranged on one end of the air intake of the inflation motor 8, on an associated device and the ends of a duct.

According to a variant of the present disclosure that is not shown, the inflation motor 8 may be remote from the mattress 2, the mattress then having an inflation port.

According to a variant of the present disclosure that is not shown, the inflation motor 8 may be fitted to the associated device 3.

According to a variant of the present disclosure that is not shown, the inflation port of the associated device 3 may be provided with an overpressure valve.

The associated device 3 may be detachable from the mattress 2.

Figure 7:
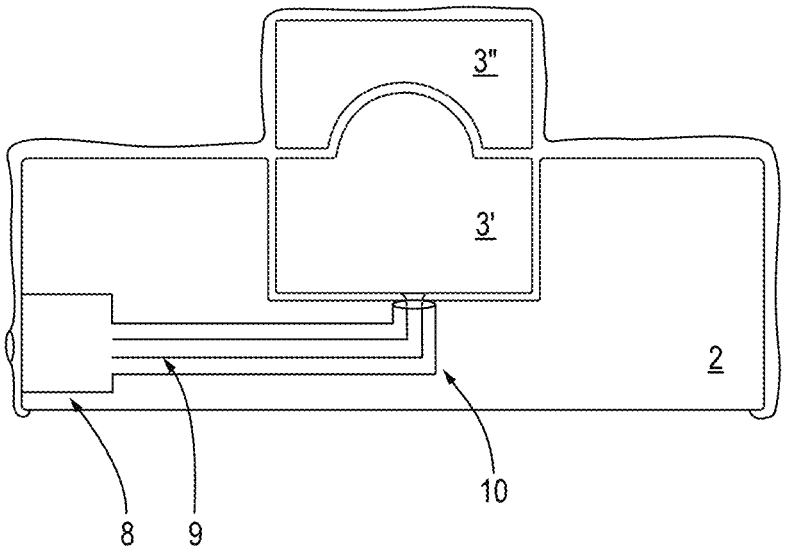

With reference to FIG. 7, it may be noted that different forms of associated devices 3' and 3" are possible.

The device 3' is inflatable and has a portion that protrudes in the form of a comforter or other shapes when inflated.

The device 3" is not inflatable, and may have a configuration complementary to that of 3', thus creating a stack of associated devices. Thus, when the device 3' inflates, the stack may protrude on the sleeping surface.

One or more associated devices 3, 3", etc., may be placed in the same groove 4.

The associated devices according to the present disclosure may be equipped with one or more pieces of fabric, arranged toward the outside of the mattress when they are positioned in the groove, so that they can be extracted more easily from the groove.

Several devices 3, 3' or 3", etc., may be completely separated, glued completely or partially (on a surface, a point, an edge, etc.).

Several devices 3, 3' or 3", etc., can be on the same mattress, together or separately.

Figure 8:
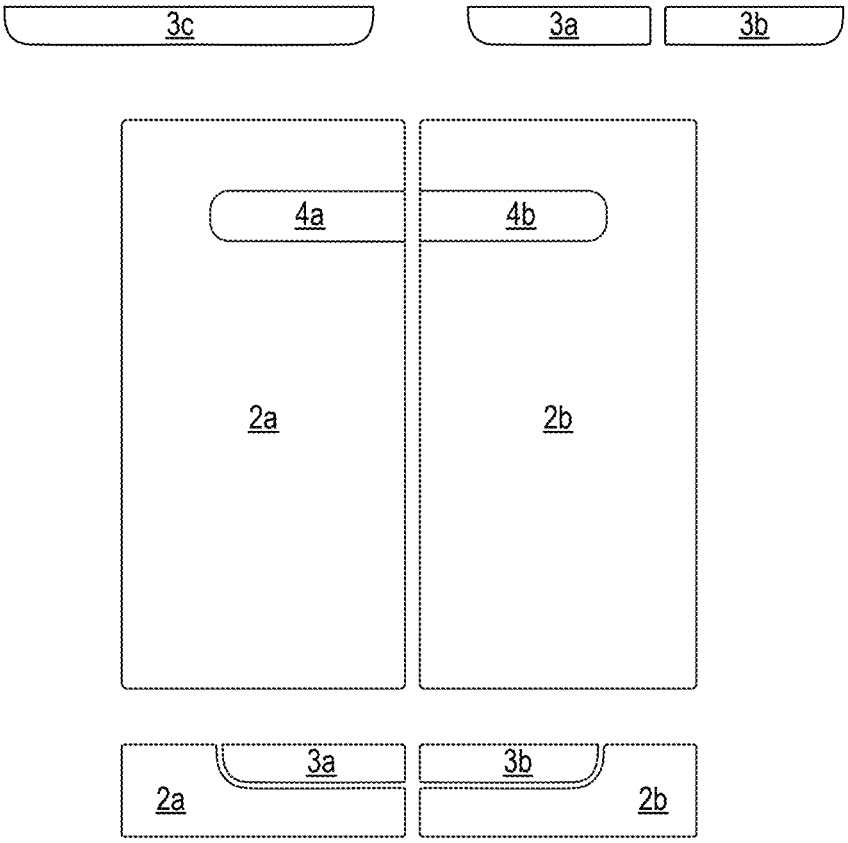

FIG. 8 illustrates the case of a double bed formed by two juxtaposed mattresses 2*a*, 2*b*. The groove may be formed and placed astride the two mattresses by two half-grooves 4*a* and 4*b*, consequently touching the medial edges, without opening onto the side edges of the two juxtaposed mattresses. The groove may be filled by two or more associated devices 3*a* and 3*b*, etc., or by a single associated device 3*c*.

Figure 9:
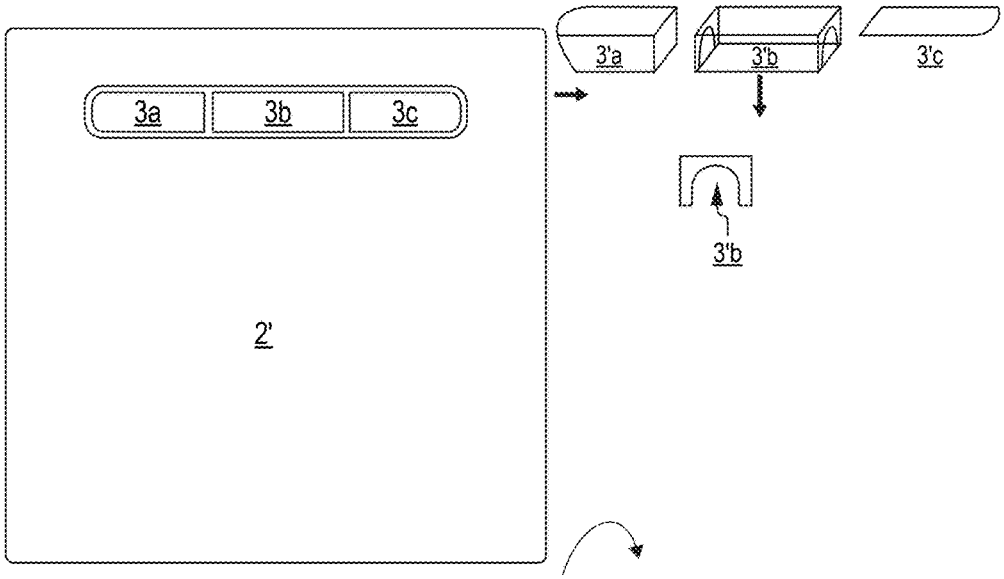

In a variant shown in FIG. 9, the device associated with a mattress 2' is composed of three juxtaposed parts 3'*a*, 3'*b*, 3'*c*. As illustrated in the figure, the middle part 3'*b* may, for example, have a hole in the form of a tunnel through which the arm can pass.

Figure 10:
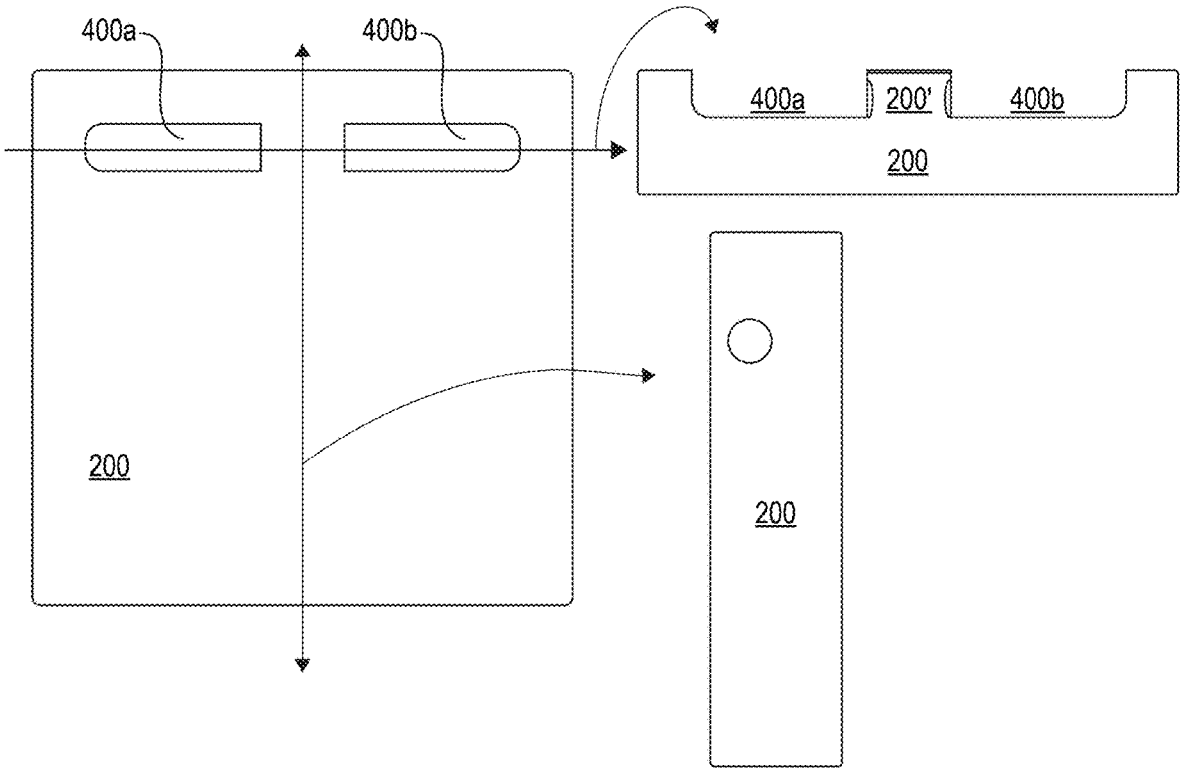

In a variant shown in FIG. 10, it is proposed that a mattress 200 has two grooves 400*a*, 400*b* separated by a central part 200' of the mattress. The central part has a predetermined width and comprises a tunnel that communicates with the two grooves. Thus, an arm can pass through the tunnel.

Rigid-type mattresses and inflatable-type mattresses are known. Although it is aimed at both types of mattresses, the present disclosure will find certain advantages for mattresses of the rigid type.

Of course, the various features, forms, variants, and embodiments of the present disclosure may be combined with one another in various combinations as long as they are not incompatible or exclusive of one another. In particular, all of the variants and embodiments described above may be combined with one another.

The invention claimed is:

1. A mattress assembly, comprising:

a mattress having an elongated open groove in a sleeping face of the mattress, the groove being only partial in a thickness of the mattress such that the groove does not extend entirely through the thickness of the mattress, the groove sized and configured to accommodate an arm of a person resting on the mattress, a length of the open groove extending in a transverse direction of the mattress, the open groove being only partial in the transverse direction such that the open groove does not extend to a side edge of the mattress; and an associated device configured to at least partially block the groove when the associated device is positioned in the groove, the associated device being blocked by five surfaces of the mattress and being movable relative to the mattress only along a single axis extending perpendicular to the sleeping face of the mattress.

2. The mattress assembly of claim 1, wherein the associated device has a conformation complementary to the groove, the associated device completely blocking the groove when the associated device is positioned in the groove.

3. The mattress assembly of claim 2, wherein the associated device has a surface flush with the sleeping face when the associated device is positioned in the groove.

4. The mattress assembly of claim 2, wherein the associated device includes a part configured to protrude on the sleeping face.

5. The mattress assembly of claim 2, further comprising a system for attaching the associated device to the mattress.

6. The mattress assembly of claim 5, wherein the associated device is inflatable.

7. The mattress assembly of claim 6, further comprising an inflation motor configured to inflate the associated device.

8. The mattress assembly of claim 7, wherein the mattress is equipped with an inflation duct opening into the groove, the inflation duct configured to be connected to an inflation port.

9. The mattress assembly of claim 8, wherein the mattress comprises the inflation motor.

10. The mattress assembly of claim 8, wherein the inflation motor is remote from the mattress, the mattress comprises the inflation port, and the inflation port is fluidly connected to the inflation duct.

11. A fitted sheet having two or more parts, the fitted sheet configured to cover and conform to a mattress assembly according to claim 1, whereof one or more of the parts of the fitted sheet is configured to cover the mattress with one or more portions configured to line the groove of the mattress, at least one other part of the fitted sheet configured to cover the associated device of the mattress assembly.

12. The mattress assembly of claim 1, further comprising a system for attaching the associated device to the mattress.

13. The mattress assembly of claim 1, wherein the associated device is inflatable.

14. The mattress assembly of claim 13, further comprising an inflation motor configured to inflate the associated device.

15. The mattress assembly of claim 14, wherein the mattress comprises the inflation motor.

16. The mattress assembly of claim 14, wherein the inflation motor is remote from the mattress, the mattress comprises an inflation port fluidly connected to an inflation duct, and the inflation duct is fluidly connected to the inflation motor.

17. A mattress assembly, comprising:

a mattress having an elongated open groove in a sleeping face of the mattress, the groove being only partial in a thickness of the mattress such that the groove does not extend entirely through the thickness of the mattress, the groove sized and configured to accommodate an arm of a person resting on the mattress, a length of the open groove extending in a transverse direction of the mattress; and an associated device configured to at least partially block the groove when the associated device is positioned in the groove, the associated device being inflatable;

wherein the mattress is equipped with an inflation duct opening into the groove, the inflation duct configured to be connected to an inflation port.

* * * * *